United States Patent [19]

Pethö

[11] Patent Number: 5,052,562

[45] Date of Patent: Oct. 1, 1991

[54] METHOD AND APPARATUS FOR SORTING ROUND OBJECTS

[75] Inventor: Lajos T. Pethö, Limoges, France

[73] Assignee: KabiVitrum AB, Stockholm, Sweden

[21] Appl. No.: 438,426

[22] PCT Filed: Mar. 13, 1989

[86] PCT No.: PCT/SE89/00129

§ 371 Date: Nov. 27, 1989

§ 102(e) Date: Nov. 27, 1989

[87] PCT Pub. No.: WO89/09098

PCT Pub. Date: Oct. 5, 1989

[30] Foreign Application Priority Data

Mar. 25, 1988 [SE] Sweden ..... 8801120-0

[51] Int. Cl.[5] ..... B07C 5/06

[52] U.S. Cl. ..... 209/626; 209/633; 209/660

[58] Field of Search ..... 209/606, 625-627, 209/629, 632, 633, 659, 660, 664, 666, 667, 673, 683, 686, 701, 557

[56] References Cited

U.S. PATENT DOCUMENTS

| | | | |
|---|---|---|---|
| 244,478 | 7/1881 | Packard | 209/664 |
| 1,905,791 | 4/1933 | Brown et al. | 209/627 |
| 2,680,516 | 6/1954 | Schuitema . | |
| 2,840,236 | 6/1958 | Belk | 209/625 |
| 3,153,484 | 10/1964 | Heiny | 209/683 |
| 3,737,033 | 6/1973 | Toth et al. | 209/626 X |
| 3,743,093 | 7/1973 | Klancnik | 209/629 X |
| 3,785,487 | 1/1974 | Spencer | 209/625 X |
| 3,997,058 | 12/1976 | Greer et al. | 209/660 X |
| 4,172,526 | 10/1979 | Moser | 209/625 |
| 4,402,412 | 9/1983 | Wood | 209/625 |
| 4,754,881 | 7/1988 | Bohle | 209/686 X |

FOREIGN PATENT DOCUMENTS

| | | | |
|---|---|---|---|
| 0311805 | 4/1919 | Fed. Rep. of Germany | 209/659 |
| 3608989 | 9/1987 | Fed. Rep. of Germany . | |
| 1178750 | 5/1959 | France . | |
| 2161158 | 7/1973 | France . | |
| 0525724 | 9/1972 | Switzerland . | |
| 0481335 | 11/1975 | U.S.S.R. | 209/666 |
| 1258504 | 9/1986 | U.S.S.R. | 209/686 |
| 1292849 | 2/1987 | U.S.S.R. . | |
| 0748069 | 4/1956 | United Kingdom | 209/659 |

*Primary Examiner*—Donald T. Hajec
*Assistant Examiner*—Edward M. Wacyra
*Attorney, Agent, or Firm*—Pollock, Vande Sande & Priddy

[57] ABSTRACT

A method and apparatus for sorting round objects which are received in a first sorter in which objects not meeting a predetermined minimum dimension are passed out of the apparatus and taken away, whereas objects meeting the predetermined minimum dimension are taken to a second sorter, through which only objects which do not exceed a predetermined maximum dimension can pass. The second sorter includes a pair of substantially parallel gauging members, between which acceptable objects can pass, while objects which are too large are taken away from the sorter.

20 Claims, 4 Drawing Sheets

METHOD AND APPARATUS FOR SORTING ROUND OBJECTS

FIELD OF THE INVENTION

The present invention relates to a method and apparatus for sorting round objects, and particularly for sorting out round objects which do not meet a given minimum or maximum dimension.

SUMMARY OF THE INVENTION

The object of the invention has been to achieve a simple method and a simple apparatus for sorting out round objects which meet given dimension requirements, such as a predetermined minimum or maximum dimension. Also in accordance with the invention, it shall be especially possible to discover faults in roundness, such as ovality.

The method and apparatus according to the invention can be used for sorting out spherically shaped as well as circular-cylindrically shaped objects, and with regard to the latter, even such that have different diameters at different parts of the object, for example, stoppers for bottles and the like.

The invention will now be described in the form of an embodiment example, which is not to be regarded as restricting the invention, and with reference to the accompanying drawings, wherein

DETAILED DESCRIPTION OF THE PREFERRED EMBODIMENT (S)

Figure 1:
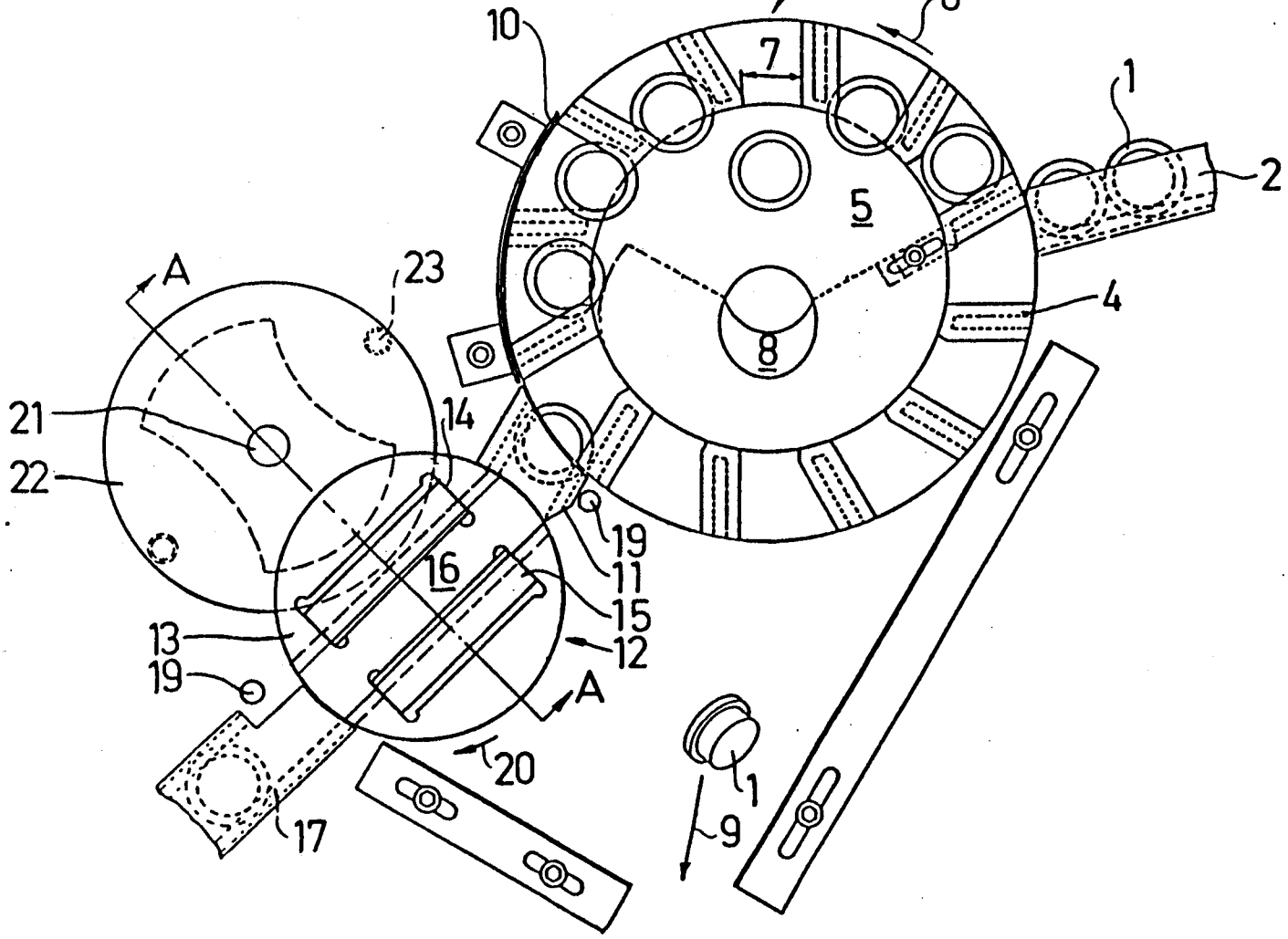
FIG. 1 is a schematic side view of a sorting apparatus in accordance with the present invention, for sorting cylindrical stoppers having two different diameters.

In FIG. 1 there is illustrated a sorting apparatus in accordance with the present invention. The objects to be sorted are stoppers 1, and as will be seen from the Figure they have a substantially cylindrical shape, where one portion of the stopper has a larger diameter than the other portion. Such a stopper may be used for closing off bottles. Facing in the right direction these stoppers are placed on a chute 2, where they move under the action of gravity towards a first sorter 3.

This sorter includes a paddlewheel-like sorting member, provided in its outer circumferential region with fixed dogs 4. The dogs 4 are substantially radially disposed and extend a distance in towards the center of the member, as far as a centrally arranged opening 5 in it. The dogs 4 are also mutually spaced for accomodating and carrying the stoppers 1. The sorting member rotates continuously in the direction of the arrow 6, and a stopper 1 that has left the chute 2 and has come between two adjacent dogs 4 thus rotates with the sorting member. The stopper also moves by gravity towards the center of the sorting member and towards the central opening 5. The mutual spacing of the dogs is, however, such that the width of the opening towards the central opening 5 between two dogs is equal to the given minimum dimension 7 for the stoppers. The stoppers that do not comply with this dimension 7 fall down between respective adjacent dogs 5 into the central opening 5, and via a reject chute 8 are taken out from the apparatus in the direction of arrow 9. The stoppers meeting the given dimension 7 will remain between their respective dog pairs and are conveyed in the direction of the arrow 6 as the sorting member continues to rotate. A fence 10 is arranged exterior to the circumference of the sorting member 9 to prevent the stoppers from falling down at an undesired place, and they are taken instead to a transfer device 11 for being led via it to a second sorter.

The transfer device 11 can be of a simple construction, such as a simple chute, which leads the stoppers 1, after they have passed through the first sorter and have met the minimum dimension, to the second sorter 12.

The second sorter 12 includes a disc 13 carrying two mutually movable members 14 and 15, in contrast to the fixed dogs 4, as will be explained below. The gauging members 14 and 15 together form a channel 16, along which the stoppers not exceeding a given maximum dimension can move. These stoppers roll by gravity to the other side of the disc 13 and out from the second sorter 12 to a discharge chute 17 for subsequently being taken to an intended production station or the like.

Figure 2:
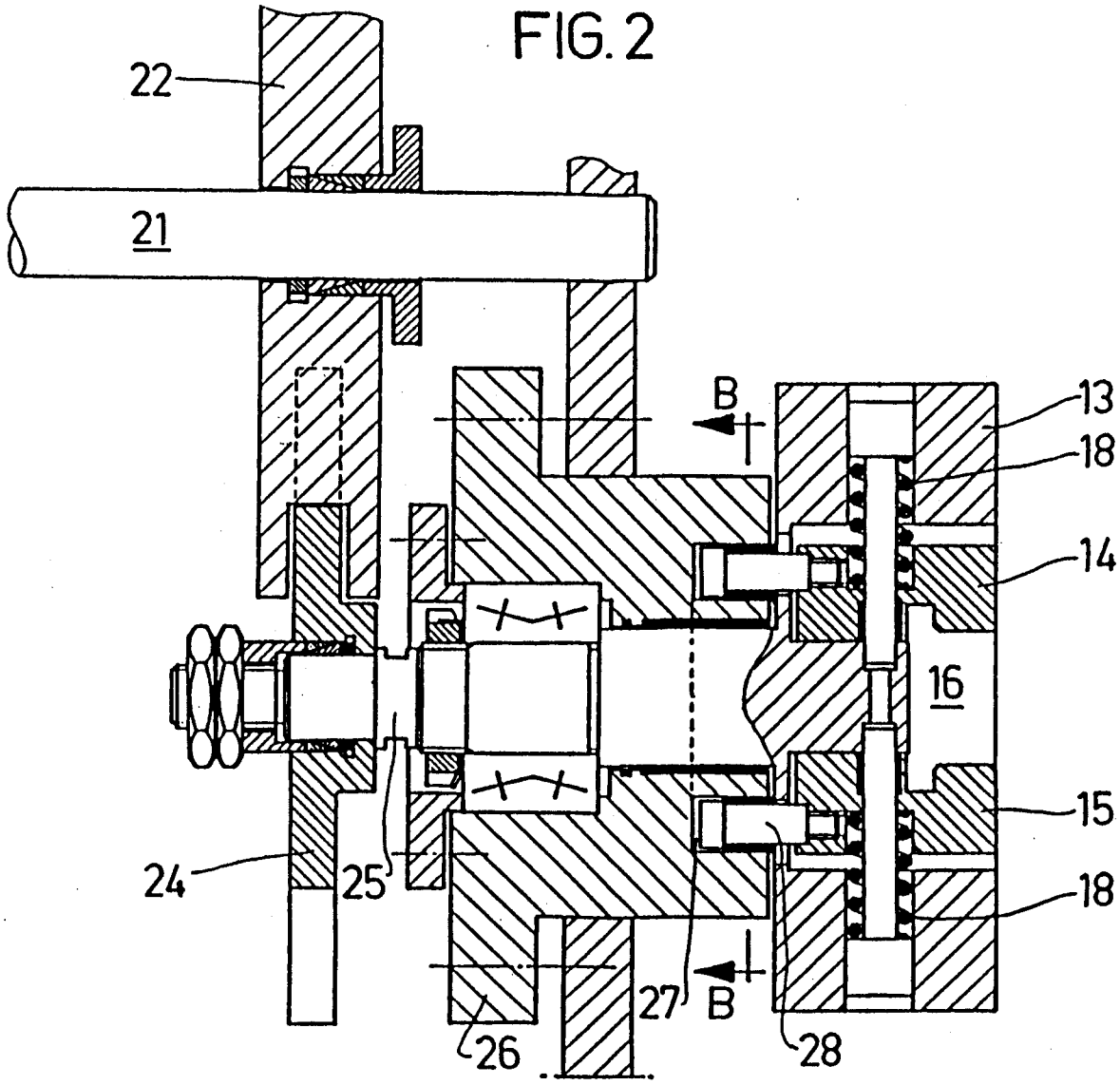
FIG. 2 is a section A—A through a part of the apparatus in FIG. 1.

As already mentioned, both gauging members 14 and 15 are mutually movably mounted on the rotatably disposed disc 13, but are kept biased towards each other in the normal case with the aid of springs 18, as will be seen from FIG. 2, and in this position they form the channel 16 having the given maximum dimension for the stoppers 1 that are to pass along it. Sensing means are arranged at either end of the channel 16, and these sense whether a stopper passes along the channel or whether it fastens at the entry to the channel or in it. The sensing means 19, for example, photocells, are mounted in positions which will be seen in FIG. 1, and thus sense whether there is something in the channel 16. When a stopper is in the channel the beam between the photocells is interrupted, and with them it can thus be decided if a stopper has fastened or not. The beam between the photocells is of course interrupted even for a stopper with the correct dimension, which can thus pass along the entire channel. Some kind of time delay means must therefore be arranged to create a delay before sorting out takes place. This time delay can also be adjusted so that a stopper that does pass along the channel 16, but takes too long a time to do so, for example, because it is somewhat oval, causes rejection. This rejection is thus activated by the beam between the photocells 19 having been interrupted for a longer time than a predetermined time. In such a case the disc 13 is rotated half a revolution in the direction of the arrow 20, simultaneously as the gauging members 14 and 15 are moved slightly apart to allow the release of a stopper that has fastened in the channel 16 and for the stopper to be discharged as a reject in the direction of the arrow 9. By the rotation of the disc 13, the end of channel 16 which was previously nearest to the transfer device 11 will now face the discharge chute 17. Since the disc with the members mounted on it is symmetrical, the direction in which the disc faces does not matter. The rotation of the first sorter 3 is stopped when rejection is activated by the photocells, so that no new stoppers will arrive at the transfer device 11 and be transferred to the second sorter 12.

When an activating signal is sent as a result of the beam between the photocells 19 having been interrupted for too long a time an (unillustrated) electric motor is activated. This motor drives a shaft 21, on which is mounted a drive wheel 22 provided with driving dogs 23, and these dogs can engage in grooves in a Maltese cross 24 mounted on a shaft 25, on which the disc is mounted. There is thus obtained a gear ratio of 2:1, so that one turn of the wheel 22 turns the disk 13 half a turn. Due to this implementation of the power transmission there is also obtained a momentary break every 90° in the rotation of the disc 13, which facilitates the release of a stopper that has retained between the gauging members 14 and 15. The shaft 25 can be driven in other ways, for example, directly by an electric motor, which is controlled such that the same pattern of movement is obtained. The shaft 25 is carried for rotation in bearings mounted in a guide member 26, which is stationary relative the shaft and is also provided with an oval guide groove 27 accommodating two guide pins 28. The guide member 26, with its groove 27 and pins 28 is specially illustrated in FIG. 3. As will be seen from FIG. 2, the pins 28 moving in the groove 27 are fixed in their respective movable gauging member 14 or 15. It will also be seen from this Figure that there is room behind these members, which allows them to move apart.

Figure 3:
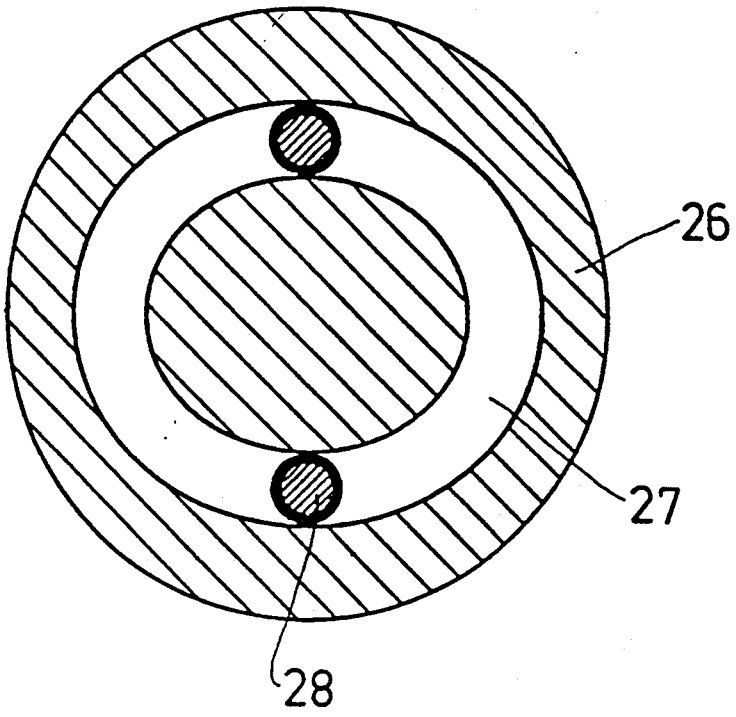
FIG. 3 is a section B—B through the part illustrated in FIG. 2.

When both photocells 19 have sent a signal activating the unillustrated motor driving the shaft 21, the latter is rotated a complete turn, and thus the drive wheel 22 also, which results in that the Maltese cross 24 is rotated half a turn, taking with it the shaft 25, on which the plate 13 is mounted. Since the guide member 26 is stationary relative to this rotation, the guide pins 28 will travel half a turn along the guide groove 27, thus increasing their mutual spacing to a maximum, for returning to the "normal" spacing on completing a turn, as illustrated in FIG. 3. Since the gauging members 14 and 15 are fixed to their respective pin, they will also move apart simultaneously as the disc 13 rotates, such that the opening of the channel 16 is turned downwards. A stopper that had been retained in the channel is thus free to be taken away in the direction of the arrow 9. Other types of sensing means than photocells 19 can be used, for example, capacitive means that sense the presence of a stopper in the channel 16.

Figure 5:
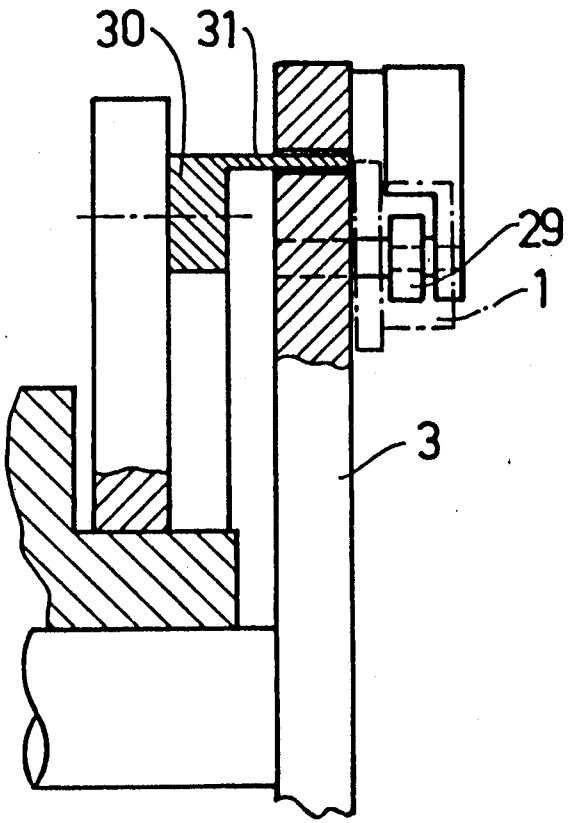
FIG. 5 is a section through the part illustrated in FIG. 4.
Figure 4:
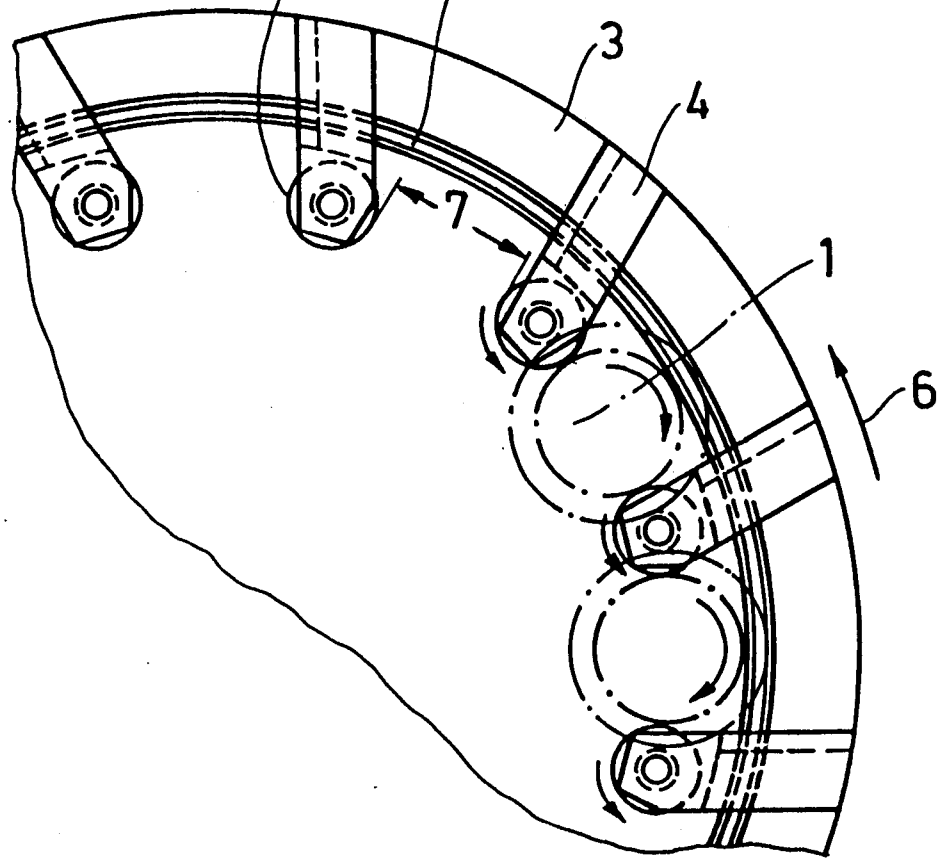
FIG. 4 illustrates a part of the inventive apparatus in a different embodiment.

Another embodiment of the first sorter 3 is illustrated in FIGS. 4 and 5. The sorting member is provided with fixed dogs here also, but in this case the dogs 4 are equipped with rollers 29 which are rotatably mounted at the ends of the dogs facing towards the central opening 5. The rollers 29 have a diameter which is somewhat greater than the width of the dogs 4, and in this case the given minimum dimension for the stoppers is formed by the spacing between two adjacent rollers 29. In addition, there is a fixed ring 30, coaxial with the sorter 3, and the ring is provided with a circumferential uppstanding flange 31, which is accommoded in a slot in the sorter 3 such that the free end surface of the flange 31 engages against a stopper situated between a pair of rollers 29 and dogs 4. The stopper is thus compelled to rotate about its own axis, and if it has a certain amount of ovality, with the smallest dimension less than the given distance 7, the stopper will reliably fall down between the two rollers 29 and be sorted out of the apparatus.

A fixed ring 30 and its flange 31, as in the apparatus of FIGS. 4 and 5, can also be arranged in the apparatus of FIG. 1, where there are only fixed dogs 4 without rollers. Rotation of the stoppers about their own axes will also be caused here when they move as the sorter rotates.

With the apparatus according to the invention there is thus obtained an excellent appliance for sorting objects that must meet given criteria with respect to both a minimum and a maximum dimension. Since the objects are caused to rotate about their own axes during sorting, objects with non-acceptable ovality can be reliably discovered. To a certain extent, stoppers that are oval will be already sorted out in the first sorter 3, when the seizing situation between the fixed dogs 4 is changed for the stoppers during rotation of the sorting member, a certain amount of ovality control thus already taking place in the first sorter.

The method and apparatus in accordance with the invention also functions for performing checks on flatness, straightness and perpendicularity. In certain types of use it can also be essential to check the coefficient of friction of the insertion part of a stopper, and even here the inventive method and apparatus can be used, since stoppers with a higher coefficient of friction will have a longer rolling time along the channel 16, and such stoppers will be sorted out in the same way as described above for oval stoppers.

I claim:

1. A method for sorting round objects, including the steps of:

inserting an object between a pair of dogs having converging spacing therebetween, said converging spacing having one end with a largest dimension and the other end with a smallest dimension, the smallest dimension of the spacing corresponding to the minimum acceptable dimension of the objects, such that an object with a dimension smaller than the minimum acceptable dimension can pass between the dogs, whereas an object with at least a minimum acceptable dimension is retained between the dogs;

rotating said dogs with the object inserted therebetween, such that the retained object is moved out from the spacing between the dogs through the end with the largest dimension;

transferring the object which moved out from the spacing between the dogs to a path formed between two parallel gauging members, said gauging members being displaceable at right angles to the path, with the distance between said gauging members in a normal state corresponding to the greatest acceptable dimension of the objects such that the object with accepted dimension passes between said gauging members while too large or deformed object is retained between said gauging members;

detecting the retention of the objects between said gauging members with a sensing means;

effecting displacement of said gauging members for increasing the distance therebetween to allow the retained object to pass between the gauging members, while simultaneously rotating said gauging members about an axis at right angles to the displacement direction of the gauging members and the longitudinal direction of said path, such that the object passing between said displaced gauging members is removed and taken away separately from the objects with accepted dimensions; and returning the gauging members to an original position with the distance therebetween corresponding to that in the normal state for receiving said objects.

2. A method according to claim 1, wherein the passage of the objects between said gauging members along said path is sensed optically, and wherein when the time during which the objects are detected in said path between said gauging members exceeds a predetermined value, the rotation and displacement and of said gauging members is activated.

3. A method according to claim 2, wherein the movement of the objects in between the fixed dogs and out from the dogs and along the path between said gauging members as well as from the path between said gauging members when displaced and rotated, is achieved by the objects rolling solely due to gravity.

4. A method according to claim 1, wherein the movement of the objects in between the fixed dogs and out from between the dogs and along the path between said gauging members as well as from the path between said gauging members when displaced and rotated, is achieved by the objects rolling solely due to gravity.

5. A method according to claim 1, wherein said gauging members are rotated a half turn during their displacement such as to come again into a position for receiving objects.

6. An apparatus for sorting round objects comprising:

a first sorter for receiving round objects from a feed means, said first sorter including a rotating, paddlewheel-like sorting member with substantially radially-directed dogs extending from the outer circumference of said sorting member at a distance inwardly towards an opening disposed at the center of the sorting member, the ends of the dogs facing towards the opening being provided with rotatably mounted rollers, the distance between two adjacent rollers corresponding to a predetermined minimum dimension of the objects, such that the objects having a dimension smaller than the predetermined minimum dimension leave said first sorter through outlet openings formed between said rollers and being in communication with said central opening, while objects having dimensions exceeding the predetermined minimum dimension are retained between the dogs and moved by said rotating sorting member to a transfer device and by said transfer device to a second sorter;

said second sorter including two substantially parallel gauging members which define therebetween a channel, having a dimension corresponding to a predetermined maximum dimension, for receiving the round objects, and for allowing for the passage of round objects between said gauging members which do not exceed the predetermined maximum dimension, whereas round objects exceeding the predetermined maximum dimension are retained between said gauging members;

said second sorter being provided with means for detecting and removing the objects that have been retained between said gauging members or have not passed along said channel during a predetermined maximum time.

7. An apparatus according to claim 6, further comprising a touch means arranged to engage against an object which is in contact with said two adjacent rollers for causing the object to rotate about its own axis when said first sorter is rotating.

8. An apparatus according to claim 7, wherein said second sorter includes a rotatable plate on which the gauging members are mounted, and wherein rotation of the plate effects movement of the gauging members away from each other.

9. An apparatus according to claim 8, wherein said gauging members are urged by springs into a mutual spacing defining said channel and wherein said gauging members engage, with the aid of guide pins, in a guide groove in an unrotatable guide member, said groove extending in an oval shape for causing the gauging members to be moved apart when the plate with the gauging members is rotated.

10. An apparatus according to claim 9, further including sensing means arranged outside the ends of said channel formed by said gauging members for sensing the presence of an object in the channel between said members.

11. An apparatus according to claim 8, further including sensing means arranged outside the ends of said channel formed by said gauging members for sensing the presence of an object in the channel between said members.

12. An apparatus according to claim 11, wherein said sensing means are photocells.

13. An apparatus according to claim 12, wherein said sensing means activates the rotation of the rotatable plate.

14. An apparatus according to claim 11, wherein said sensing means activates the rotation of the rotatable plate.

15. An apparatus according to claim 6, wherein said substantially parallel gauging members in the second sorter are arranged at an angle to the vertical such that a round object that is to pass between said members is caused to roll with the aid of gravity between said gauging members.

16. An apparatus for sorting round objects, comprising: at least a pair of dogs having converging spacing therebetween, the smallest dimension of the spacing at one end thereof corresponding to a minimum acceptable dimension of the objects and defining an outlet means, such that an object with a dimension smaller than the minimum acceptable dimension can pass between the dogs, whereas an object with at least a minimum acceptable dimension is retained between the dogs;

means for rotating said dogs with the object inserted therebetween, such that the retained objects are moved out from the spacing between the dogs at the other end opposite to said one end;

transferring means for transferring the object moved from the spacing between the dogs to a path which is formed between two substantially parallel gauging members displaceable at right angles to the path, the distance between said gauging members, in a normal state, corresponding to the greatest acceptable dimension of the objects such that the objects with accepted dimensions pass between said gauging members while too large or deformed objects are retained between said gauging members;

sensing means for detecting the retention of the objects between said gauging members;

means for effecting displacement of said gauging members for increasing said distance therebetween to allow the retained objects to pass between the gauging members;

means for simultaneously rotating said gauging members about an axis at right angles to the displacement direction of the gauging members and the longitudinal direction of said path, and for returning the members to an original position with a distance therebetween corresponding to that in the normal state and for receiving new objects.

17. A method according to claim 16, wherein the passage of the objects between said gauging members along said path is sensed optically, and wherein when the time during which the objects are detected between said gauging members exceeds a predetermined value, the rotation and displacement of said gauging members is activated.

18. An apparatus according to claim 16, further comprising a rotatable plate on which the gauging members are mounted, and wherein rotation of the plate activates displacement of gauging members away from each other.

19. An apparatus according to claim 16, wherein said gauging members are urged by springs into a mutual spacing defining said path and said predetermined maximum dimension and wherein said gauging members engage, with the aid of guide pins, in a guide groove in an unrotatable guide member, said groove extending in an oval shape for causing the gauging members to be moved apart when the plate with the gauging members is rotated.

20. An apparatus for sorting round objects comprising:

a first sorter for receiving round objects from a feed means into a plurality of converging spaces, said first sorter being provided with outlet openings which are formed at the smallest ends of said converging spaces and through which round objects not complying with a predetermined minimum dimension defined by said outlet openings leave said first sorter, while objects complying with the predetemined minimum dimension are being transferred from said first sorter by a transfer device to a second sorter, said second sorter including two substantially parallel displaceable gauging members which define therebetween a channel with a predetermined maximum dimension for receiving said round objects, and allowing for the passage along said channel between said gauging members of round objects which do not exceed the predetermined maximum dimension, whereas round objects exceeding the predetermined maximum dimension are retained in said channel between said members, said second sorter being provided with means for displacement of said gauging members away from each other for removal of the objects that have been retained between said gauging members or have not passed along said channel during a predetermined maximum time period.

* * * * *